United States Patent [19]

Millen et al.

[11] Patent Number: 4,724,429

[45] Date of Patent: Feb. 9, 1988

[54] DIAGNOSTIC AND CONTROL SYSTEM FOR CIGARETTE FILTER ROD MAKING MACHINE

[75] Inventors: William L. Millen; John L. Allen, Jr., both of Charlotte, N.C.

[73] Assignee: Celanese Corporation, New York, N.Y.

[21] Appl. No.: 837,464

[22] Filed: Mar. 7, 1986

[51] Int. Cl.[4] ..... G08B 19/00

[52] U.S. Cl. ..... 340/679; 131/280; 131/910; 340/521; 493/4; 493/31; 493/34; 493/39

[58] Field of Search ..... 340/679, 675, 521; 131/910, 280; 493/4, 31, 34, 39

[56] References Cited

U.S. PATENT DOCUMENTS

| | | | |
|---|---|---|---|
| 3,741,846 | 6/1973 | Greve . | |
| 3,793,512 | 2/1974 | Lorenzen . | |
| 3,971,695 | 7/1976 | Block . | |
| 4,043,454 | 8/1977 | Reuland . | |
| 4,283,998 | 8/1981 | Greve et al. . | |
| 4,498,078 | 2/1985 | Yoshimura et al. . | |
| 4,511,420 | 4/1985 | Arthur . | |
| 4,513,921 | 4/1985 | Imoda et al. . | |
| 4,563,228 | 1/1986 | Luders et al. . | |
| 4,595,027 | 6/1986 | Higgins et al. | 131/280 |
| 4,599,699 | 7/1986 | Steward-Cox et al. | 131/280 |
| 4,682,158 | 7/1987 | Ito et al. | 340/679 |

OTHER PUBLICATIONS

Filter Facts 8, Eastman Chemical Products, Inc. (Apr., 1986).

Publication No. ETB-182, Eastman Kodak Company (Jan., 1986).

*Primary Examiner*—Glen R. Swann, III

*Attorney, Agent, or Firm*—Robert J. Blanke

[57] ABSTRACT

A system for monitoring each of multiplicity of variables in the operation of a filter rod making machine includes sensors located at various points on the machine. These sensors measure the value of such variable parameters as the width of the tow, the alignment of the wrapping paper, the speed of the rollers and the level of plasticizer. Each measured value is compared against preset limit values in a microprocessor. If a variable is detected to be outside a range of acceptable values, an indication of this fact is displayed on a monitor. In response to this indication, an operator can decide whether to override the limit value or take corrective action. If corrective action is to be taken, the microprocessor causes a diagnostic chart to be displayed. This chart provides the operator with a sequence of troubleshooting steps that can be taken to isolate the source of a possible problem and perhaps correct it before there is a need to arrest the operation of the machine.

11 Claims, 7 Drawing Figures

Fig. 3A
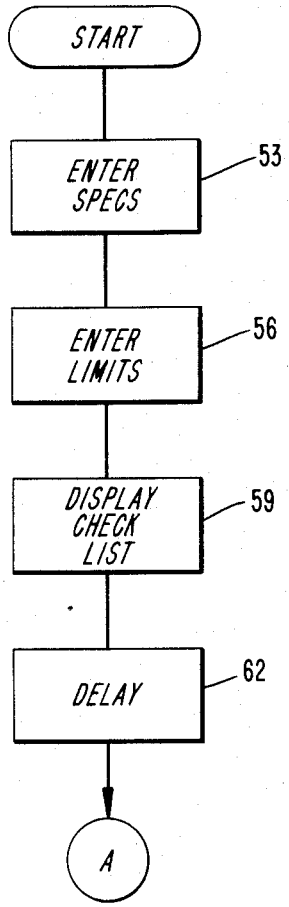
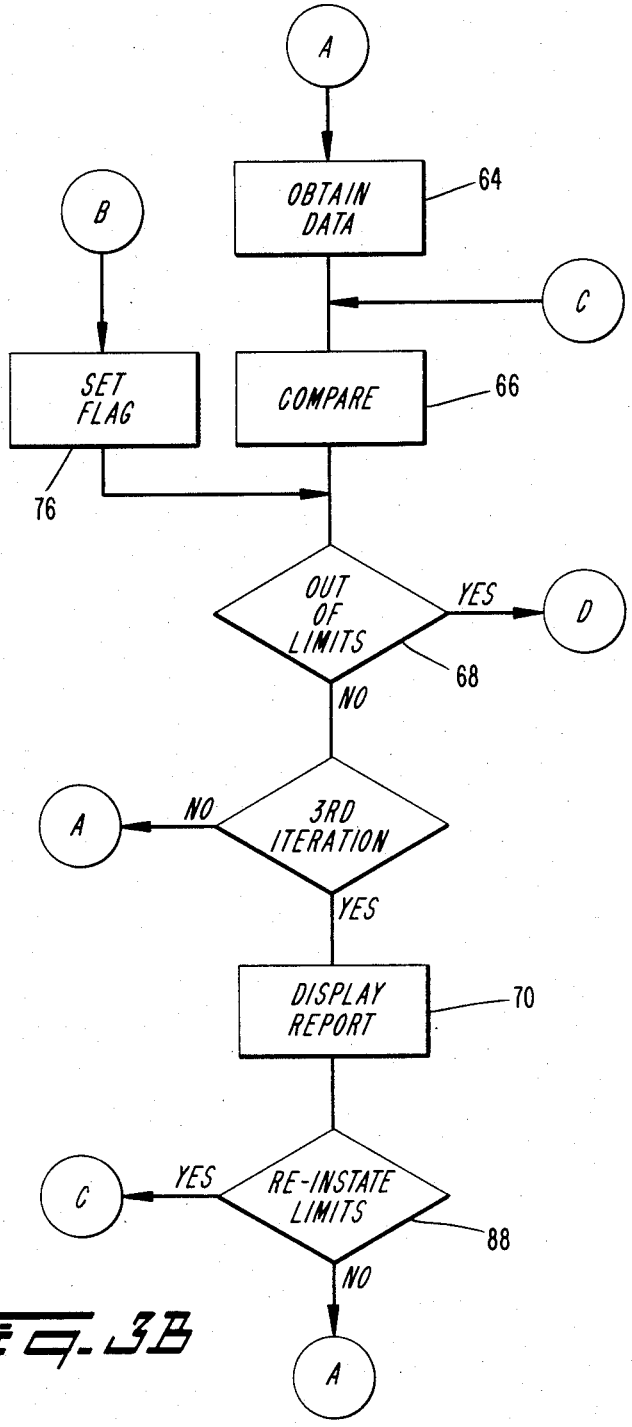
Fig. 3B

Fig. 3C

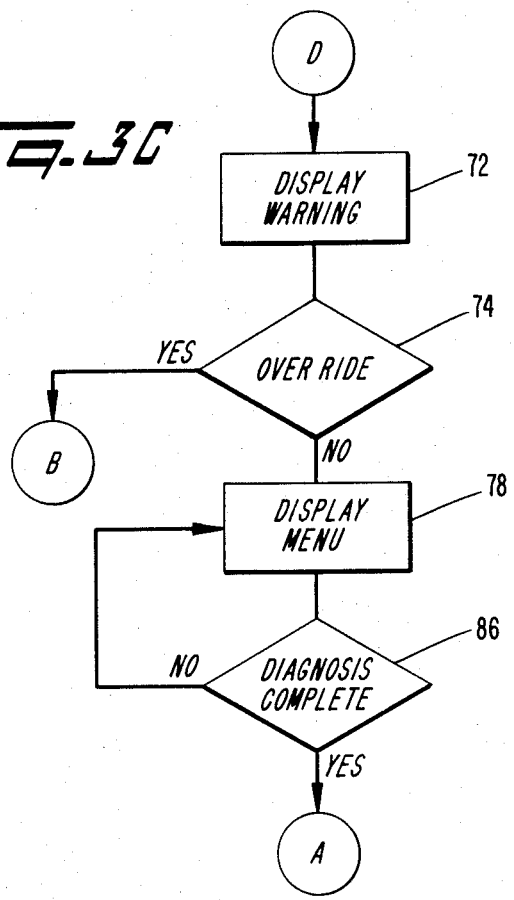

Fig. 4

41. TOW PROBLEMS

POSSIBLE CAUSES

A: TOW BAND TOO NARROW AT MAIN AIR SPREADER

80

| | |
|---|---|
| 1. THREADED ROLLS RUNNING TOO SLOWLY | |
| 2. EXCESSIVE PRESSURE OR DEFECTIVE BEARINGS AT STABILIZING ROLLS | |
| 3. INADEQUATE AIR PRESSURE AT MAIN AIR SPREADER | 21 |
| 4. DIRTY AIR SPREADER | 21 |

SUGGESTED CORRECTION PROCEDURE

82

| | |
|---|---|
| 1. INCREASE RATIO AND FEED ROLL SPEEDS | 31 |
| 2. DECREASE PRESSURE AT STABILIZING ROLLS | |
| 3. INCREASE AIR FLOW AT MAIN AIR SPREADER | 93 |
| 4. CHECK MAIN AIR SPREADER | 93 |
| 5. CHECK RUBBER ROLLS ON AT 2 FOR WEAR | 34 |

84

DIAGNOSTIC AND CONTROL SYSTEM FOR CIGARETTE FILTER ROD MAKING MACHINE

BACKGROUND OF THE INVENTION

The present invention relates to the manufacture of smokers' products, and in one embodiment is particularly concerned with the manufacture of cigarette filter rods. More specifically along these lines, the invention is directed to the integrated monitoring, diagnosis and correction of possible faults in machines for such manufacture.

In the tobacco processing industry the manufacture of smokers' products is carried out with high-speed machines that produce large quantities of products in unit time. For example, a machine for producing cigarette filter rods from a continuous tow of filamentary material might normally process the tow at speeds of around 200–400 meters per minute to produce filter rods at a rate of 4000 per minute. Due to the high speed at which they operate and the various functions that must be performed in order to carry out such a manufacturing process, these machines tend to have a fairly high level of complexity. It is thus inevitable that conditions such as wear, misalignment or failure of components of the machine can lead to situations which will require the manufacturing operation to be stopped and the source of a problem repaired.

Systems are known in which the machine is automatically halted when a malfunction is detected during its operation. One example of such a system is shown in U.S. Pat. No. 3,793,512. In the operation of this system, essential or critical components of a machine for manufacturing smokers' products are monitored, and the machine is arrested upon the detection of a malfunction. The interval of time during which the machine is arrested, i.e. while the necessary repairs are made to correct the malfunction, is recorded for subsequent evaluation.

While it is convenient to have a system which automatically shuts down the machine in the event of a malfunction, so that possible damage or waste of raw materials can be avoided, it will be appreciated that any interruption of a high speed manufacturing machine is costly in terms of lost production. Furthermore, the necessary down time of the machine to perform required repairs is lengthened because of its complexity and the need for specialized training. More particularly, a large number of filter rod making machines are typically employed by one manufacturer of smokers' products. Each machine, or a group of a small number of machines, will typically have an operator who is responsible for the start-up of the machine and the proper supply of necessary raw materials such as plasticizer and tow. This person is generally not qualified to repair the machine if a malfunction occurs. Rather, a more skilled person who has served a 3–5 year apprenticeship is responsible for maintaining all of the machines in working order Because the skilled repair person could be in charge of several machines, it could take a considerable period of time before he is able to repair a malfunction at any particular machine.

In the past, other control systems have been used to monitor the final product and automatically regulate the operation of isolated aspects of the machine. In one exemplary system, the weight or density of the cigarette filter rod is monitored and used to control the feed rate of the tow or the rate of application of the plasticizer.

While these types of systems have helped to increase the quality or yield of the final product, they do not provide the operator with the type of diagnostic tool necessary to identify machine errors and shorten costly down time or avoid waste of materials. For example, quite frequently the supply of plasticizer runs out before the operator realizes that a reservoir needs refilling. During the time that the reservoir is empty, the machine can continue to run and significant amounts of tow and wrapping paper will be wasted since the resultant products are defective and cannot be recycled.

Accordingly, it is an object of the present invention to provide a system that monitors the operation of the machine and alerts the operator to the occurrence of a condition that could lead to a malfunction. By providing an early warning of these conditions, such a system would enable the operator to take corrective action as well as reduce the waste of expensive raw materials.

It is another object of the invention to provide a novel monitoring system that affords an operator with an integrated overview of all vital machine functions. Further along these lines, it is an object of the invention to provide such a system which presents diagnostic information to an operator so that the cause of a possible malfunction can be given attention before machine shutdown is required.

It is a further object of the present invention to provide a system of this type that also facilitates the automatic correction or control of possible error conditions.

BRIEF STATEMENT OF THE INVENTION

In accordance with these objects, the present invention provides a system for monitoring each of a multiplicity of functions in the operation of a filter rod making machine. Sensors located at various points on the machine measure the value of such variable parameters as the width of the tow, the alignment of the wrapping paper, the speed of the rollers and the level of plasticizer. Each measured value is compared against preset limit values in a microprocessor. If a variable is detected to be outside a range of acceptable values, an indication of this fact is displayed on a monitor. As one feature of the invention, an operator can decide whether to override the limit value or take corrective action. If corrective action is to be taken, the microprocessor causes a diagnostic chart to be displayed. This chart provides the operator with a list of troubleshooting steps that can be taken to isolate the source of a possible problem and perhaps correct it before there is a need to arrest the operation of the machine.

As another feature of the invention, the microprocessor can carry out various corrective procedures automatically, thereby decreasing the need for manual input from the operator.

These and other concepts embodied in the invention are explained in greater detail hereinafter with reference to a preferred implementation of the invention illustrated in the accompanying drawings.

BRIEF DESCRIPTION OF THE DRAWINGS

FIGS. 3A, 3B and 3C are, flow charts illustrating the operation of the microprocessor in the monitoring and diagnostic mode;

FIG. 4 is an example of one type of diagnostic menu that can be displayed in response to an error condition.

DESCRIPTION OF THE ILLUSTRATED EMBODIMENT

Figure 1:
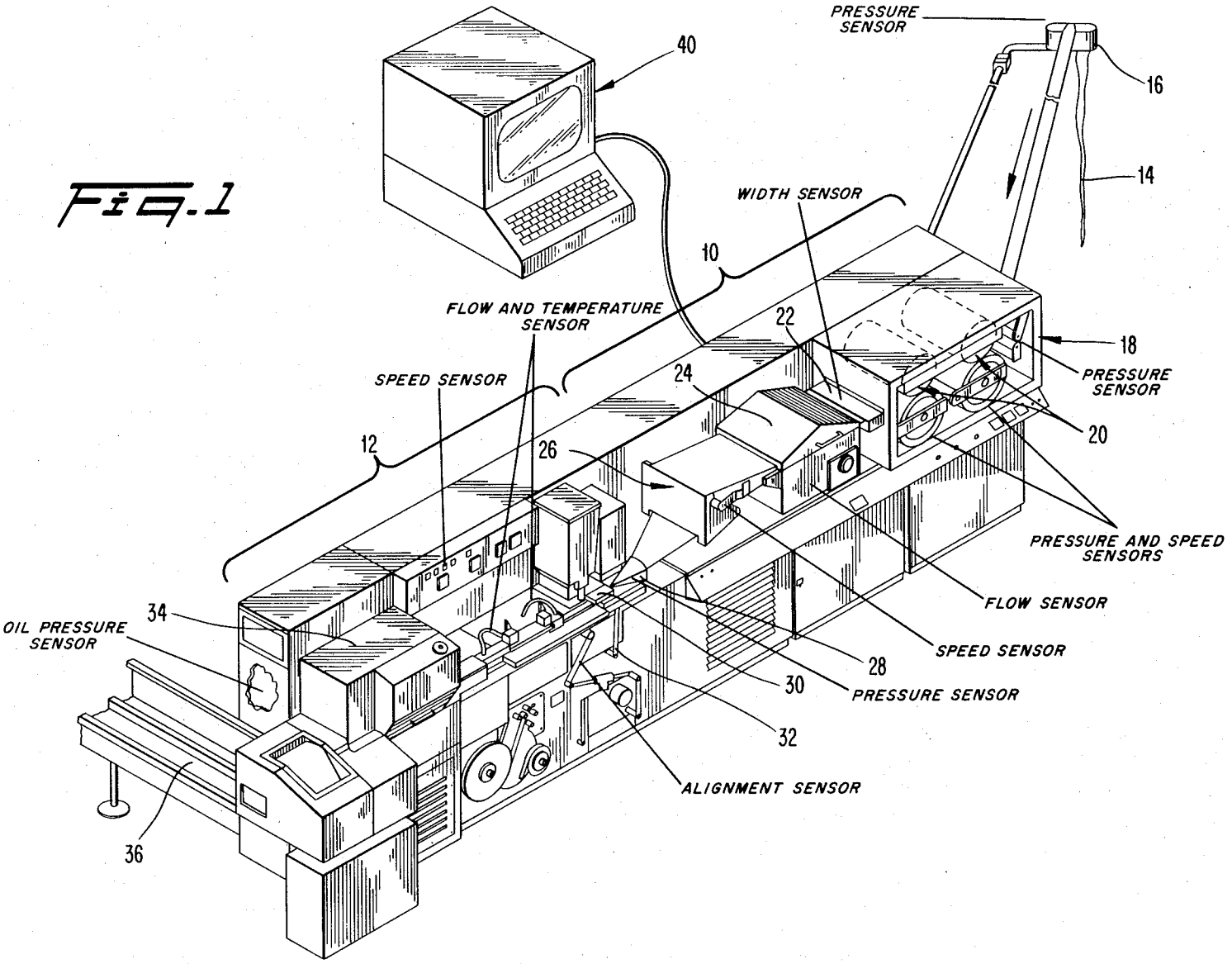
FIG. 1 is a perspective view of a machine for automatically making cigarette filter rods.

Referring to FIG. 1, a machine for the manufacture of cigarette filter rods is illustrated. The machine is comprised of two main units, a tow opening unit 10 and a rod forming unit 12. In the opening unit 10, a web 14 of crimped tow material from a bale (not shown) first passes through an initial spreader 16 which flattens the web into a generally planar shape. The tow is then opened, i.e. the crimp in adjacent fibers is deregistered, to impart greater bulk and maximize the surface area of the material. This opening action can be carried out in a threaded roller unit 18. In one type of opening unit, crimp deregistration is effected by two sets of rollers 20 in tandem, each having a lower threaded roller and an upper bias roller made, for example, of rubber. The direction of the thread is opposite for the two threaded rollers. As the tow passes between the nips of the two sets of rollers, individual fibers are subjected to differential gripping action which produces relative longitudinal displacement, causing the crimps to move out of registry with one another.

Other alternative types of units can be used to open the tow. For example, systems which employ a single threaded roller or air jets are also known and available.

After being opened, the tow passes through a main spreader 22 which regulates the width of the tow before it is presented to a plasticizer applicator 24. In the applicator, a suitable plasticizer which can contain optional flavoring agents is deposited on the tow. Upon its emergence from the applicator, the tow passes over delivery rollers 26 and proceeds to the rod forming unit 12.

In the rod-forming unit, the plasticized tow material is fed into a funnel 28 which gathers it into a rod-like shape. The tow then proceeds to a garniture member 30 which is also supplied with wrapping paper 32 in web form. Within the garniture member, the paper is wrapped around the tow and subjected to heat to cause the combined structure of the paper and the tow to maintain its rod-like shape. Finally, the structure passes through a cutting mechanism 34 where it is severed into rods of suitable length. These rods are deposited on a conveyor belt 36 to be transported to further machinery where they are joined with the tobacco portion of the cigarette to make filter-tipped products.

Figure 2:
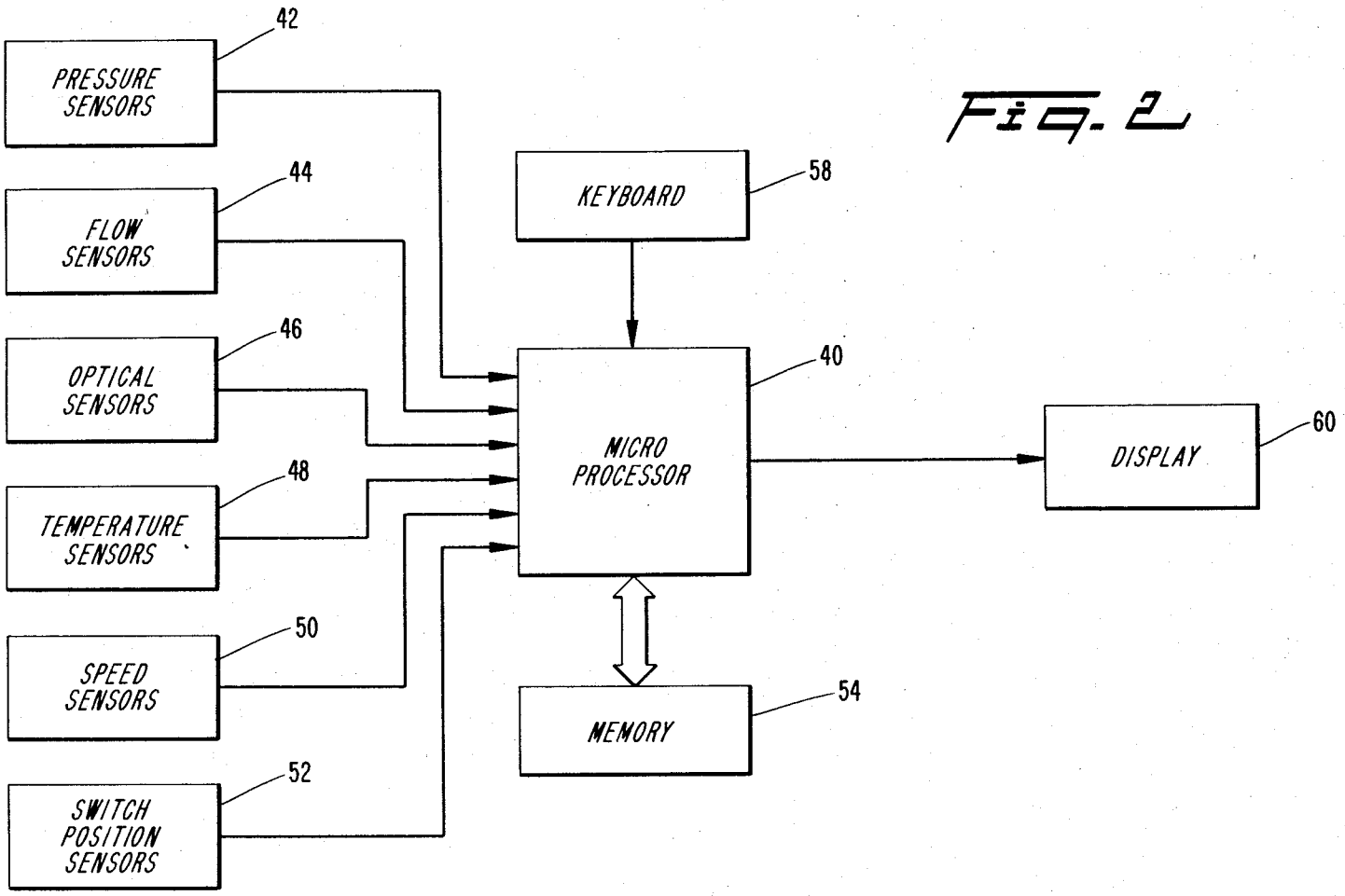
FIG. 2 is a block diagram of the monitoring and diagnostic system.

In accordance with one aspect of the present invention, a machine of this type is provided with a monitoring and diagnostic system. This system includes a microprocessor-based control unit 40 that can be embodied in a microcomputer or the like. This control unit communicates with a multiplicity of sensors mounted on the machine. Referring to FIG. 2, these sensors can measure the values of a number of different types of parameters. For example, pressure sensors 42 can be used to sense the pressure of oil that is used to lubricate various moving mechanisms, the pneumatic pressure exerted on the delivery and tow opening rollers, and the air pressure in such components as the initial spreader 16, the main spreader 22 and a transport jet at the funnel 28. Flow sensors 44 can detect the flow of plasticizer in the applicator 24 and coolant water in the garniture member 30. Optical sensors 46 such as infrared position sensors can be used to determine the location of an edge of the wrapping paper web 32 to ensure that it is tracking properly and the location of an edge of the tow after it emerges from the main spreader 22 to be sure that the band of tow has the proper width. Temperature sensors 48 can measure the temperature in the garniture and the temperature of the coolant water. Speed sensors 50 can measure the rotational speeds of the rollers and the speed of transport of the materials through the garniture member. FIG. 1 indicates where some of these sensors can be located on the machine.

In addition, the positions of individual safety switches in the machine can be detected by sensors 52. For example, some of these switches might be emergency stop switches that are manually actuated by the operator and that need to be re-set before machine operation can commence. Other switches might detect whether a piece of equipment is not in its proper operating position, such as a hood over the opening unit 18 or the cutter 34.

The parameter value or machine condition that is detected by each of these sensors is fed as an input signal to the microprocessor 40. Operation of the monitoring and diagnostic system is explained with additional reference to FIGS. 3A, 3B and 3C, which are flow charts illustrating the operation of the microprocessor. When the system is first activated, the initialization procedure shown in FIG. 3A is carried out. As a first step (block 53), a memory 54 is loaded with data related to the operation of the machine. This information can comprise the operator's name, identification of the type of tow and plasticizer, and other data of interest. Then, a limit value or limit range is entered into the memory for each parameter that is measured or detected by the sensors 42–52 (block 56). For example, some of the measured parameters might only have one limit value stored in the memory, such as a minimum flow for the plasticizer. Other parameters such as the measured pressures might have upper and lower limits stored in the memory to define a range of acceptable values. For still other sensors such as the switch sensors, the stored value might simply be a state of the switch, i.e. open or closed.

These limit values can be entered into the memory 54 by means of a keyboard 58 associated with the microcomputer. Preferably, however, some of the stored limit values are established automatically in response to the information that is entered at block 53. For example, initial spreader pressure limits for different types of tow can be stored in a table, and the proper set of limits transferred to a register when a particular tow type is entered.

Once all information has been entered, a check list (block 59) is displayed on a display such as a video monitor 60. This check list defines a series of steps for the operator to follow to start up the machine and begin the manufacture of filter rods. Once start-up has been initiated, a suitable delay, e.g. 30 seconds, is imposed to enable the machine to get up to operating speed (block 62). At the end of the delay, the microprocessor proceeds to the monitoring routine illustrated in FIG. 3B.

As a first step in the monitoring routine, the microprocessor obtains the data from each of the sensors 42–52 (block 64). Then, the measured values are sequentially compared with their associated limit values or limit ranges stored in the memory 54 (block 66) and a determination is made whether any limits have been passed (block 68). If all of the sensed parameters lie within their ranges of acceptable values, the microprocessor repeats this process of obtaining data and comparing it against the stored limit values for an arbitrarily chosen number of times, which is three in the illustrated example. After the third time, a report listing the measured value or state of each parameter, as well as the additional information that was stored in the memory at step 53, is generated and displayed (block 70). If desired, the operator can have the option of printing the report on paper.

Referring now to the diagnostic routine illustrated in FIG. 3C, if a parameter is detected to lie outside of its acceptable range at block 68, this fact is indicated on the video display 60 (block 72). In response to this indication, the operator has the option of overriding the limit value (block 74). For example, a low air pressure in the initial spreader 16 may not be of concern for some types of tow, and so the limit can be ignored. If the operator decides to override the limit, an appropriate key on the keyboard 58 is actuated to communicate an override signal to the microprocessor. In response to this signal, a flag is set next to the limit value stored in the memory (block 76) to indicate that the limit is to be disregarded in future comparisons. The monitoring procedure then continues in the normal manner.

If the operator decides not to override the stored limit value, a diagnostic menu is displayed on the screen (block 78). This menu can identify the probable causes for the out-of-limit condition, and provides a step-by-step troubleshooting sequence for the operator to follow to try to correct the condition. For example, if flow of plasticizer is not detected it may simply be the case that the reservoir for the plasticizer is empty. In such a case, the diagnostic menu can inform the operator to check the level in the reservoir. Other out-of-limit conditions might require a more complex diagnostic routine. One example of a diagnostic menu is shown in FIG. 4.

The particular error condition that is represented in FIG. 4 is a band of tow that is too narrow at the main spreader 22. The diagnostic menu has a first section 80 which is an identification of possible causes for the error condition. These possible causes are listed in order of decreasing likelihood of occurrence. Following this section, a suggested correction procedure 82 is set forth. This procedure identifies a series of troubleshooting steps that the operator can follow to isolate and correct the problem. The order of these steps is preferably related to the probability of occurrence of the possible causes.

The diagnostic menu also contains numbers 84 appearing adjacent some of the listed probable causes and corrective steps. These numbers refer to additional menus that the operator can optionally retrieve for further reference. For example, the first suggested correction procedure refers to a menu 31. This menu might be a guide to the manner in which various adjustments are made in the tow opening unit 10, and provide the operator with more detailed instructions on how to increase the speed of the rollers.

A number of these optional reference menus can be stored in the memory 54. The operator can access these in order to obtain information about the theory of operation and control of the machine. Preferably, these menus are arranged in a modular form associated with the various functions of the machine. Thus, as any particular function is modified, the appropriate menu module can be updated or revised as appropriate.

After the appropriate diagnostic action has been taken, the operator actuates a key to signal this fact to the microprocessor (block 86). The procedure then continues in the normal fashion.

Once the report has been generated after the appropriate number of iterations, the operator has the choice of re-instating any limits that were previously overridden (block 88, FIG. 3B). If the limits are not re-instated, the procedure returns to the original starting point where data is obtained, and continues in the normal manner, ignoring those limits which have been overridden. If the limits are re-instated, the microprocessor returns to step 66 and compares the latest measured data against the re-instated limits to determine if the machine operation is now acceptable.

If desired, the option of changing the limits can be provided to supervisory personnel at this point. Also, it may be desirable to automatically re-instate a limit after it has been overridden for a predetermined number of cycles.

As a further feature of the invention, the information that is obtained during the monitoring routine can be used to provide automatic feedback control of machine functions. More specifically, once an out-of-limit condition is identified during step 68 of the process illustrated in FIG. 3B, the microprocessor can produce an output signal which adjusts a machine condition to bring the condition back into the limit range.

Figure 5:
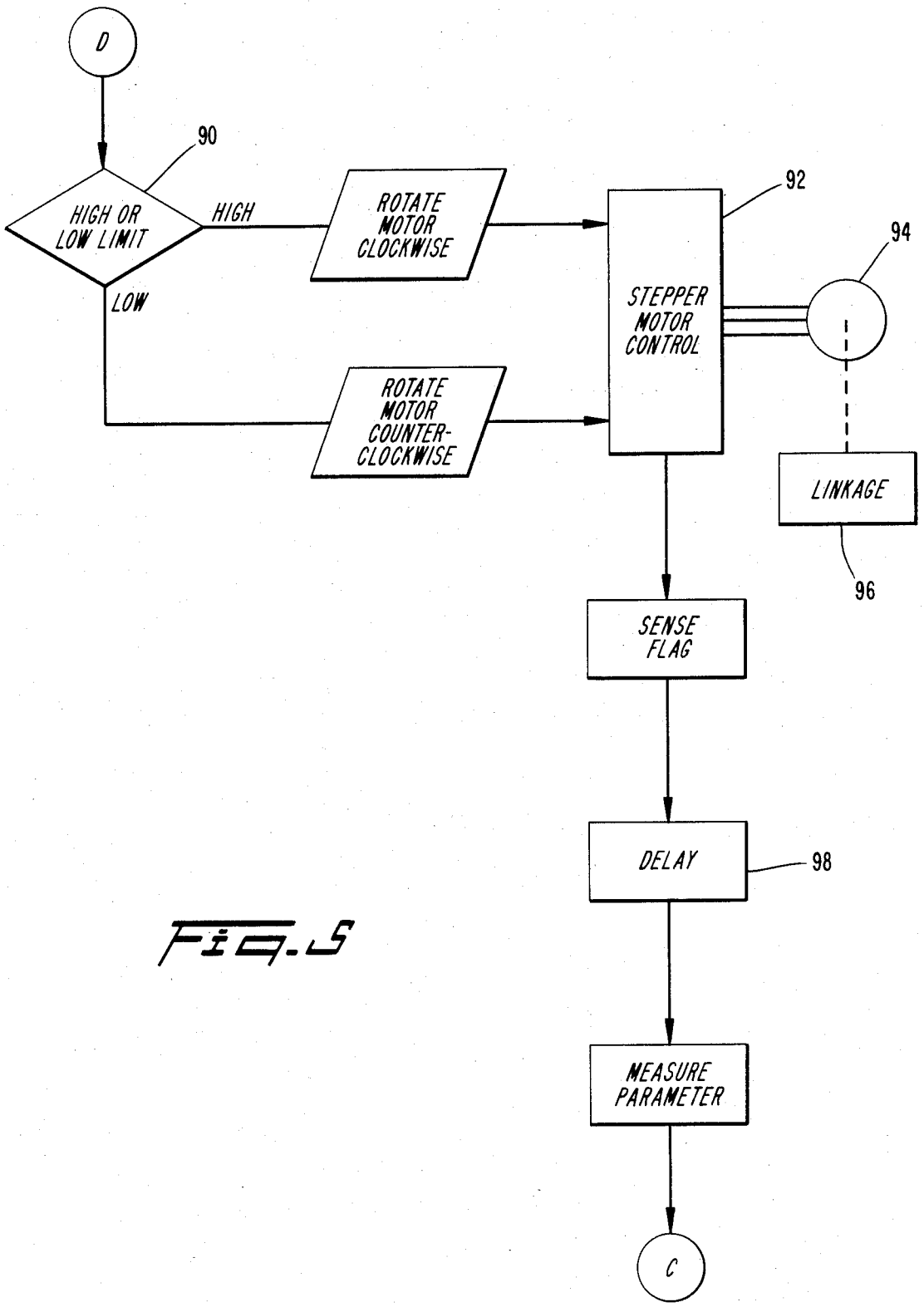
FIG. 5 is a flow chart of the feedback control mode of operation.

One example of the operation of the microprocessor in such a mode is illustrated in FIG. 5. This example also relates to the sensing of improper width of the tow. As noted in the troubleshooting routine of FIG. 4, the primary response to such a condition is to change the speed of the rollers in the tow opening unit 18. When improper tow width is detected, the microprocessor first determines whether the tow is too wide or too narrow (block 90). In response to this determination a signal is sent to a stepper motor controller circuit 92 to cause it to rotate a stepper motor 94 in one direction or the other. In addition, the motor can be rotated by an amount corresponding to the measured deviation from the limit value. The stepper motor is connected to a mechanical linkage 96 or the like which adjusts the speeds of the rollers of concern.

When the stepper motor has been rotated the proper amount, the controller 92 sends a flag signal to the microprocessor. Upon detection of the flag, the microprocessor waits a suitable delay time (block 98). The delay is calculated to enable the tow width to adjust to the changing of the roller speeds. At the end of the delay the tow width is again measured, and the program returns to the monitoring routine and continues in the normal fashion, using the new value for the tow width.

In addition to stepper motors, a feedback control routine of this type can be used to control other types of transducers, for example air pressure regulators and the like.

Furthermore, the microprocessor can be responsive to the initial entry of information at step 53 to automatically set some of the parameters. For example, when the type of tow is entered into the memory, the microprocessor can retrieve the limit values for that tow and automatically set roller speeds, pressures, etc. at values between the limit points, e.g. their average value.

From the foregoing it will be appreciated that the present invention encompasses a monitoring and diagnostic system which provides an unskilled machine operator with an integrated overview of all vital machine functions. With appropriate setting of the limit values, an early enough warning of an undesirable condition can be given so that corrective action can possibly be taken prior to an need to halt the operation of the machine. Even if the machine must be stopped, the corrective action can be performed early enough so that unnecessary damage to machine elements does not occur and waste of raw materials is avoided.

Furthermore, when the automatic feedback control is incorporated into the monitoring system, the need to rely on operator reaction to an error condition is reduced.

It will be appreciated by those of ordinary skill in the art that the present invention can be embodied in other specific forms without departing from the spirit or essential characteristics thereof. For example, although particularly disclosed with respect to filter rod manufacturing machines, the system can work equally well with other machines for the manufacture of smokers' products. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A system for monitoring and providing diagnostic evaluation of a machine for the manufacture of cigarette filter rods in which crimped filament tow is opened and deregistered, plasticizer is applied to the tow, and the tow is formed into a rod-like shape and enclosed in a wrapping material, said system comprising:

a plurality of sensors mounted on said machine for respectively detecting the values of parameters which can vary during the operation of the machine;

means responsive to said sensors for comparing the detected value of each parameter with at least one predetermined limit value for that parameter;

means for displaying a visual message that the detected value of a parameter has passed said limit value;

manually operable means for generating a signal that indicates whether said limit value is to be overridden in response to said message; and means responsive to said signal for selectively displaying a diagnostic chart listing a troubleshooting procedure for identifying and correcting a possible malfunction in the operation of the machine.

2. The monitoring and diagnostic system of claim 1 further including means for displaying information relating to the operation of a component of the machine in response to a manually generated request signal.

3. The monitoring and diagnostic system of claim 1 wherein some of said parameters are indicative of the operating status of elements of said machine and others of said parameters are related to characteristics of materials that are processed in the machine to form said filter rods.

4. The system of claim 3 wherein one of said parameters is the alignment of a web of said wrapping material, and the sensor for detecting said parameter comprises optical means for tracking the position of an edge of said web.

5. The system of claim 3 wherein one of said parameters is the width of a band of the tow after it has been deregistered, and the sensor for detecting said parameter comprises optical means for tracking the position of an edge of said band of tow.

6. The system of claim 3 wherein said machine includes a plurality of safety interlock switches which, when actuated, halt the operation of said machine, and one of said parameters is the status of said switches, and wherein said message indicates which of said switches is in an actuated state.

7. A method for providing integrated monitoring of each of a multiplicity of functions that are performed in a machine for manufacturing cigarette filter rods, comprising the steps of:

sensing the value of each of a multiplicity of parameters that are related to the performance of said functions in the machine;

storing in a memory at least one limit value for each of said parameters;

comparing in a microprocessor the sensed value of each parameter with its associated limit value that is stored in the memory;

detecting when a sensed value passes its associated limit value; and displaying a textual message on a video monitor that the sensed value has passed the limit value, and requesting a response signifying whether the limit value is to be overridden.

8. The method of claim 7 further including the step of displaying a diagnostic chart which indicates probable causes for the value of the parameter passing the limit value when a response is given that signifies the limit value is not be overridden.

9. The method of claim 7 wherein said memory contains a table of limit value for different types of raw materials that are processed in said machine, and wherein said storing step comprises the steps of manually entering information into said memory which identifies one particular type of raw material, and automatically retrieving from said table the limit value pertaining to that type of raw material.

10. A method for providing integrated monitoring and control of each of a multiplicity of functions that are performed in a machine for manufacturing smokers products, comprising the steps of:

sensing the value of each of a multiplicity of parameters that are related to the performance of said functions in the machine;

storing in a memory at least one limit value for each of said parameters, said memory including a table of limit values for different types of raw materials that are processed in said machine, and wherein said storing step comprises the steps of manually entering information into said memory which identifies one particular type of raw material, and automatically retrieving from said table the limit values pertaining to that type of raw material;

comparing in a microprocessor the sensed value of each parameter with its associated limit value that is stored in the memory;

detecting when a sensed value passes its associated limit value; and automatically adjusting one of said parameters to thereby bring the sensed parameter to an accepted value.

11. The method of claim 10 further including the step of automatically adjusting one of said parameters to a predetermined value in response to said manual entry step.

* * * * *